US006233774B1

(12) United States Patent
Vogt

(10) Patent No.: US 6,233,774 B1
(45) Date of Patent: May 22, 2001

(54) APPARATUS FOR CLEANING A GOLF BALL

(76) Inventor: James B. Vogt, 12077 E. Mission La., Scottsdale, AZ (US) 85259

( * ) Notice: Subject to any disclaimer, the term of this patent is extended or adjusted under 35 U.S.C. 154(b) by 0 days.

(21) Appl. No.: 09/293,417

(22) Filed: Apr. 16, 1999

(51) Int. Cl.[7] ..... A63B 47/04; A63B 57/00; A47L 25/00

(52) U.S. Cl. ..... 15/104.93; 15/118; 15/210.1

(58) Field of Search ..... 15/21.2, 104.93, 15/104.94, 118, 210.1, 218, 218.1, 220.4; 206/315.9; 224/919; 401/9, 10, 11

(56) References Cited

U.S. PATENT DOCUMENTS

| | | | | |
|---|---|---|---|---|
| 2,530,746 | * | 11/1950 | Wetherby | 15/104.94 |
| 2,622,257 | | 12/1952 | Lemonds et al. | 15/104.92 |
| 2,690,581 | * | 10/1954 | Di Gesare | 15/210.1 |
| 2,822,558 | | 2/1958 | Vandervort et al. | 15/21.2 |
| 3,101,497 | | 8/1963 | Derkocz | 15/21.2 |
| 3,806,983 | * | 4/1974 | Cunningham et al. | 15/210.1 X |
| 4,084,287 | * | 4/1978 | Ingram et al. | 15/210.1 |
| 4,953,999 | * | 9/1990 | Rivers | 401/9 |
| 5,308,406 | | 5/1994 | Wallock et al. | 134/42 |
| 5,641,103 | * | 6/1997 | Potik et al. | 224/919 X |
| 5,772,090 | * | 6/1998 | Rodriguez | 224/919 X |
| 5,829,086 | | 11/1998 | Billek | 15/21.2 |
| 5,839,631 | * | 11/1998 | Hebert et al. | 224/919 X |
| 5,898,968 | * | 5/1999 | Beattie | 15/210.1 |
| 6,029,850 | * | 2/2000 | Pate et al. | 224/919 X |

FOREIGN PATENT DOCUMENTS

| | | | | |
|---|---|---|---|---|
| 237599 | * | 2/1962 | (AU) | 15/104.93 |
| 8536 | * | 5/1905 | (GB) | 15/21.2 |
| 7955 | * | 1/1915 | (GB) | 15/21.2 |
| 201266 | * | 8/1923 | (GB) | 15/21.2 |
| 258417 | * | 9/1926 | (GB) | 15/21.2 |

* cited by examiner

*Primary Examiner*—Mark Spisich
(74) *Attorney, Agent, or Firm*—Parsons & Goltry; Michael W. Goltry; Robert A. Parsons

(57) ABSTRACT

Apparatus for cleaning a golf ball comprising a pliant receptacle having a first end for receiving the golf ball, a second end for expelling the golf ball, an abrasive portion adjacent the first end and a liquid absorbent portion adjacent the second end.

19 Claims, 2 Drawing Sheets

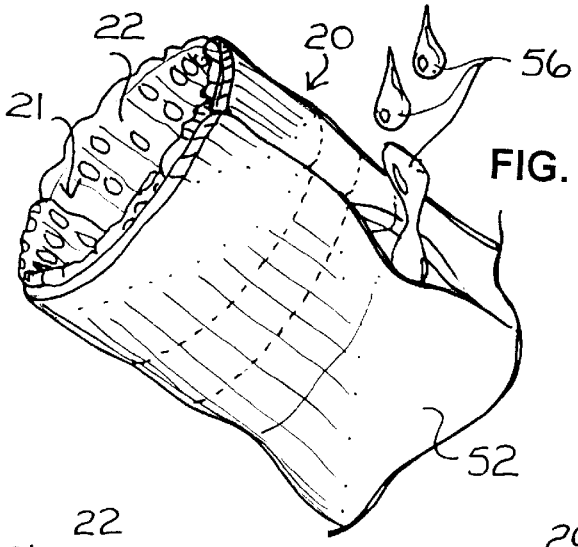
FIG. 4
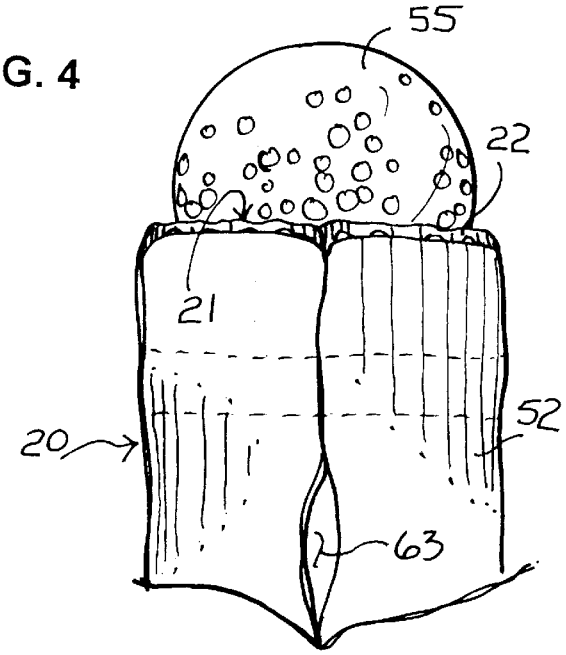
FIG. 5
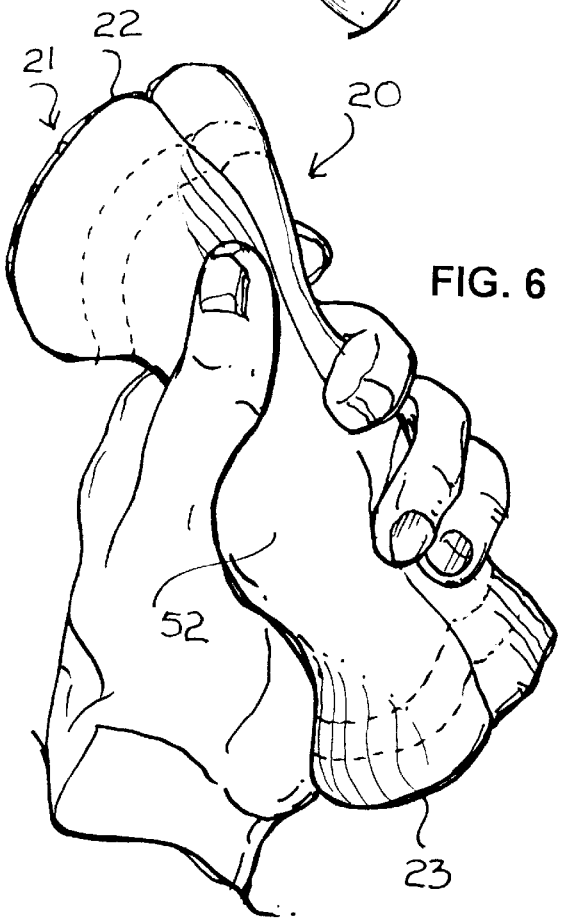
FIG. 6
FIG. 7
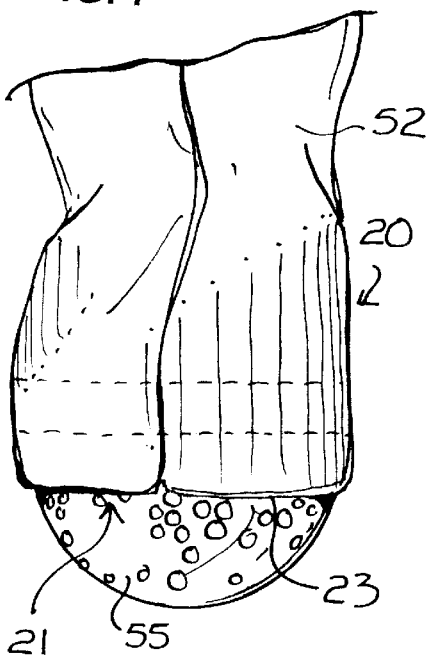

APPARATUS FOR CLEANING A GOLF BALL

FIELD OF THE INVENTION

This invention relates generally to cleaning apparatus and, more particularly, to apparatus and methods for cleaning golf balls.

BACKGROUND OF THE INVENTION

The devoted golfer pays special attention to the condition and cleanliness of his golf clubs. When the grooves in the club heads become filed with dirt, grass and debris, the ability of the grooves to grip the golf ball when struck diminishes. To ensure proper flight or travel when struck, the golf ball must also be clean. Although most golf courses provide golf ball cleaning devices, they are normally found only at intermittent locations, which limits the ability of a golfer to properly wash a golf ball whenever desired. To eliminate this problem, skilled artisans have devoted considerable effort toward portable golf ball cleaning devices that golfers may carry and employ when necessary. However, present portable golf ball cleaning devices are difficult to construct, expensive and difficult to use, which therefore necessitates certain new and useful improvements.

Accordingly, it would be highly desirable to provide new and improved apparatus and methods for cleaning golf balls.

It is a purpose of the invention to provide new and improved apparatus for cleaning golf balls that is easy to construct.

It is another purpose of the invention to provide new and improved apparatus for cleaning golf balls that is easy to use and transport.

It is still another purpose of the invention to provide new and improved apparatus for cleaning golf balls that is inexpensive.

It is a further purpose of the invention to provide new and improved methods for cleaning golf balls that are easy to carry out and convenient.

It is still a further purpose of the invention to provide new and improved apparatus that is portable and, when exposed to a massaging force, highly efficient for cleaning a golf ball contained therein.

SUMMARY OF THE INVENTION

The above problems and others are at least partially solved and the above purposes and others realized in new and improved apparatus and methods for cleaning golf balls. In a particular embodiment, apparatus of the invention comprises a pliant receptacle having a first end for receiving the golf ball, a second end for expelling the golf ball, an abrasive portion adjacent the first end and a liquid absorbent portion adjacent the second end. The abrasive portion is preferably liquid absorbent for containing a cleansing liquid such as water or a liquid detergent. The pliant receptacle is normally, but not essentially, contained by a cover that is pliant and substantially liquid impermeable. The invention may include a clip for supporting the receptacle. The clip is preferably engagable so as to be worn by a golfer. Furthermore, a substantially water impermeable barrier separates the abrasive portion from the liquid absorbent portion for preventing liquid or moisture transfer between the two portions.

BRIEF DESCRIPTION OF THE DRAWINGS

The foregoing and further and more specific objects and advantages of the invention will become readily apparent to those skilled in the art from the following detailed description taken in conjunction with the drawings in which:

FIG. 4 is a fragmented perspective view of the apparatus of FIG. 1 shown receiving a cleansing liquid; and FIGS. 5–7 illustrate the apparatus of FIG. 1 as it would appear in use for cleaning a golf ball.

DETAILED DESCRIPTION OF A PREFERRED EMBODIMENT

The present invention provides new and improved apparatus and methods for cleaning golf balls. Ensuing embodiments are easy to construct and use, and prove exemplary for allowing golfers to clean golf balls as needed during play. In the interest of clarity, the ensuing discussion sets for the structural features of the apparatus comprising the invention in §A, and the method of using the apparatus of the invention for cleaning a golf ball in §B.

§A. Apparatus

Figure 1:
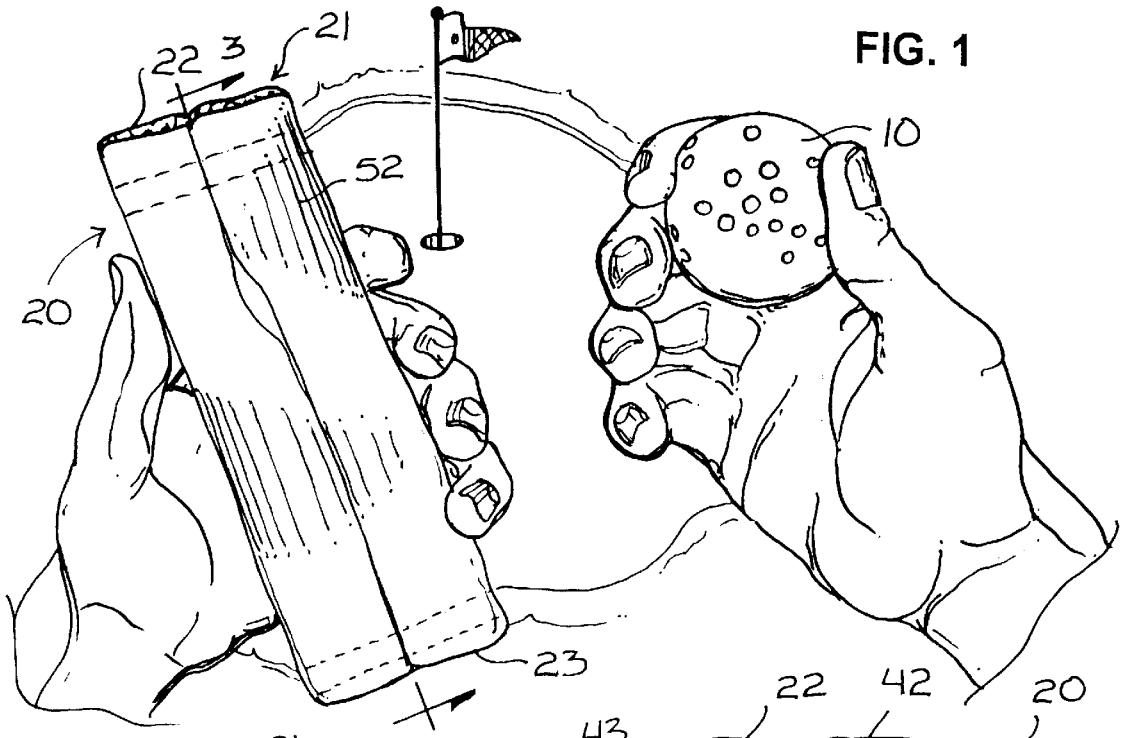
FIG. 1 illustrates a golf ball and an apparatus for cleaning a golf ball, both shown as they would appear being held.
Figure 3:
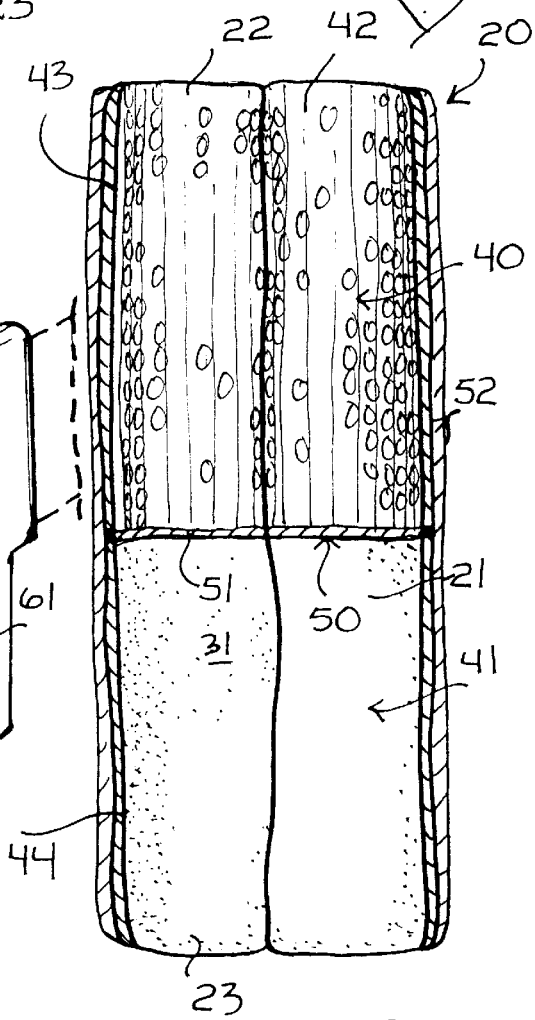
FIG. 3 is a sectional view taken along line 3—3 of FIG. 1.

Turning now to the drawings, in which like reference characters indicate corresponding elements throughout the several views, attention is first directed to FIG. 1 which illustrates a typical and well known golf ball 10 and apparatus 20 for cleaning a golf ball, both shown as they would appear being held. Apparatus 20 is preferably constructed of a size that may be hand held and easily transported. Turning to FIG. 3 illustrating a sectional view taken along line 3—3 of FIG. 1, apparatus 20 is generally comprised of a receptacle or enclosure 21 having an end 22 sized for receiving golf ball 10 and another end 23 sized for expelling golf ball 10. In this specific embodiment, receptacle 21 includes a substantially tubular shape, although other shapes may be employed if desired without departing from the present teachings. Receptacle 21 bounds a channel or compartment 31 extending between ends 22 and 23. Ends 22 and 23 are each open and communicate with compartment 31.

Receptacle 21 is divided into an abrasive portion 40 adjacent end 22 and a liquid absorbent portion 41 adjacent end 23. Abrasive portion 40 includes an abrasive element 42 and a liquid absorbent backing 43. Abrasive element 42 faces compartment 31, provides an abrasive characteristic and may be provided as continuous as shown or as a discrete patch. Backing 43 is preferably pliant and constructed of a liquid absorbent material such as cotton, terry cloth, sponge or the like, and may be provided as continuous as shown or as a discrete patch. The liquid absorbent characteristic of backing 43 permits it to receive and hold a cleansing liquid such as water or a selected liquid detergent, and to provide the abrasive element 42 with the cleansing liquid. The abrasive element 42 is preferably pliant and may comprise an abrasive nylon netting as shown, or other similar pliant abrasive material. Backing 43 normally supports abrasive element 42. To this end, abrasive element 42 is normally fastened to backing 43 with a suitable adhesive or by way of conventional sewn features.

Liquid absorbent portion 41 comprises a liquid absorbent element 44 that faces compartment 31 and provides a liquid absorbing characteristic. Liquid absorbent element 44 is preferably pliant and constructed of a liquid absorbent material such as cotton, terry cloth, sponge or the like, and may be provided as continuous as shown or as a discrete patch. The liquid absorbent characteristic of liquid absorbent element 44 permits it to absorb and hold liquid such as water, cleansing liquid, etc.

In the embodiment shown in FIG. 3, a substantially liquid impermeable barrier 50 separates the abrasive portion 40 from the liquid absorbent portion 41. Liquid impermeable barrier 50 comprises a continuous annular element 51 to which abrasive portion 40 and liquid absorbent portion 41 abut and, preferably, engage such as with a suitable adhesive or conventional sewn features. In this regard, abrasive element 42 and backing 43 engage one side of annular element 51, and liquid absorbent element 44 engages another side of annular element 51. Annular element 51 is pliant and constructed of plastic, rubber or other similar substantially liquid impermeable material that prevents or substantially inhibits liquid transfer between the abrasive portion 40 and the liquid absorbent portion 41.

A pliant cover 52 normally contains receptacle 21. In this specific example, cover 52 substantially conforms to the outer extremity of receptacle 21, extends from end 22 to end 23 of receptacle 21 and is preferably constructed of a substantially liquid resistant or impermeable material such as canvas, vinyl, the substantially liquid impermeable material found under the exemplary trademark GORTEX TM, etc. Cover 52 is normally fastened to receptacle 21 with a suitable adhesive or conventional sewn features.

§B. Method of Cleaning a Golf Ball

Having described the structural characteristics of apparatus 20, its operation for cleaning a golf ball will now be addressed in connection with FIGS. 5–7. In operation, a user may take a golf ball 55 and pass it into compartment 31 through end 22 (FIG. 5) which, of course, is sized for receiving a typical golf ball. After passing golf ball 55 through end 22, the user may grasp apparatus 20, such as with a hand (FIG. 6), and exert a massaging force to receptacle 21. In response to this massaging force, the user may move the golf ball through receptacle 21 from end 22 to end 23 and, in sequence, engage abrasive portion 40 against golf ball 55 to clean it, engage liquid absorbent portion 41 against golf ball 55 to remove any moisture from it and pass the clean and dry golf ball 55 from compartment 31 through end 23 (FIG. 7). This process may be repeated as necessary. To enhance the ability of apparatus 20 to clean a golf ball, a cleansing liquid 56 (FIG. 4), such as water or a selected liquid detergent, may be provided to backing 43 to provide abrasive portion 40 in a moistened condition. When receptacle 21 is acted upon with a massaging force for cleaning a golf ball with abrasive portion 40, the moistened backing 43 provides abrasive element 42 with the cleansing liquid for increased cleaning ability. When receptacle 21 is subsequently acted upon with a massaging force for drying a golf ball with liquid absorbent portion 41, the liquid absorbent element 44 absorbs and removes the cleansing liquid from the golf ball.

Figure 2:
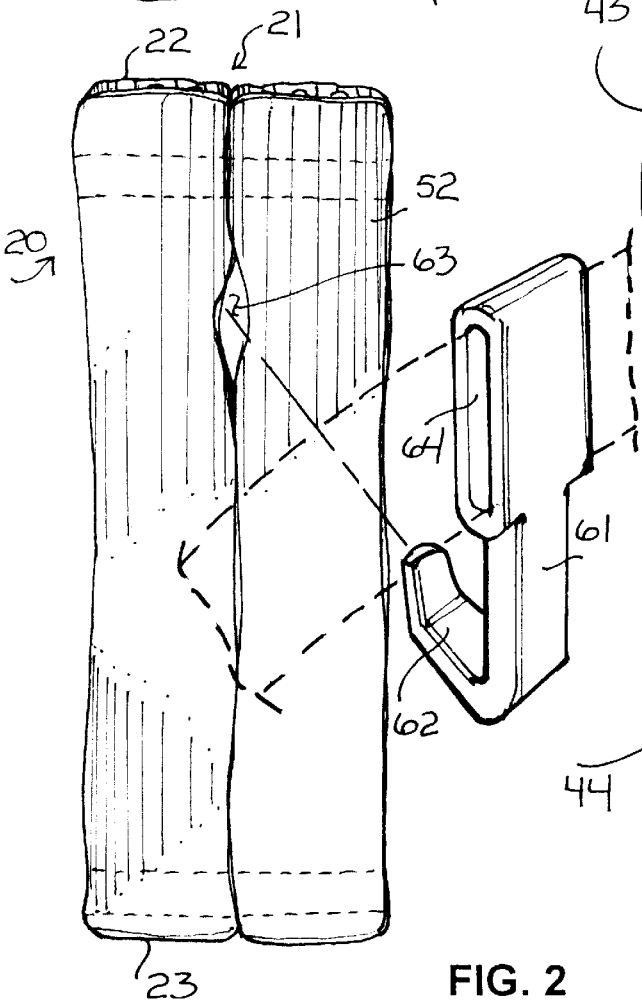
FIG. 2 is a side elevational view of the apparatus of FIG. 1 and a clip shown spaced from the apparatus, the clip for supporting the apparatus and engagable so as to be worn.

In summary, the present invention provides exemplary apparatus and methods for cleaning golf balls. To increase ease of use with attention directed to FIG. 2, the invention may further include a clip 60 for normally supporting apparatus 20. In this embodiment, clip 60 including a body 61 having a hooked end 62 receivable into an opening 63 formed through cover 52 for support, and a slot 64 opposing the hooked end 62 for accommodating, for instance, a belt of the type worn for supporting a golfer's trousers. In this regard, a golfer may pass his belt through the slot 64 so as to wear the clip 60, and then pass hooked end 62 into opening 63 for supporting apparatus 20. During normal use, the golfer may remove apparatus 20 from clip 60, employ apparatus 20 for cleaning one or more golf balls, and then re-engage apparatus 20 with clip 60. Those or ordinary skill will appreciate that other clip forms or engagement apparatus such as hook and loop fasteners or snap fasteners for allowing apparatus 20 to be worn by a golfer may be employed without departing from the invention.

The present invention has been described above with reference to a preferred embodiment. However, those skilled in the art will recognize that changes and modifications may be made in the described embodiments without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. Apparatus responsive to application of a massaging force thereagainst for cleaning a golf ball comprising a pliant cover containing a pliant receptacle having a first end for receiving the golf ball, a second end for expelling the golf ball, a pliant and liquid absorbent abrasive portion adjacent the first end and a pliant liquid absorbent portion adjacent the second end.

2. Apparatus of claim 1, wherein the cover is substantially liquid impermeable.

3. Apparatus of claim 1, further including a clip for normally supporting the receptacle and engagable so as to be worn.

4. Apparatus of claim 1, wherein a pliant and substantially liquid impermeable barrier separates the abrasive portion from the liquid absorbent portion.

5. Apparatus of claim 1, wherein the abrasive portion comprises a pliant abrasive element overlying a pliant liquid absorbent backing.

6. Apparatus responsive to application of a massaging force thereagainst for cleaning a golf ball comprising a pliant receptacle having a first end for receiving the golf ball, a second end for expelling the golf ball, a pliant and liquid absorbent abrasive portion adjacent the first end and a pliant liquid absorbent portion adjacent the second end.

7. Apparatus of claim 6, wherein the pliant receptacle is contained by a pliant cover.

8. Apparatus of claim 7, wherein the cover is substantially liquid impermeable.

9. Apparatus of claim 7, further including a clip for normally supporting the receptacle and engagable so as to be worn.

10. Apparatus of claim 6, wherein a pliant and substantially liquid impermeable barrier separates the abrasive portion from the liquid absorbent portion.

11. Apparatus of claim 6, wherein the abrasive portion comprises a pliant abrasive element overlying a pliant liquid absorbent backing.

12. Apparatus responsive to application of a massaging force thereagainst for cleaning a golf ball comprising a pliant receptacle contained by a pliant and substantially liquid impermeable cover, the receptacle bounding a compartment and having a first end for receiving the golf ball into the compartment, a second end for expelling the golf ball from the compartment, a pliant abrasive portion facing the compartment adjacent the first end and a pliant liquid absorbent portion facing the compartment adjacent the second end.

13. Apparatus of claim 12, wherein a pliant and substantially liquid impermeable barrier separates the abrasive portion from the liquid absorbent portion.

14. Apparatus of claim 12, wherein the abrasive portion comprises a pliant liquid absorbent backing and an overlying pliant abrasive element which faces the compartment.

15. Apparatus responsive to application of a massaging force thereagainst for cleaning a golf ball comprising a pliant receptacle bounding a compartment, the receptacle having a first end for receiving the golf ball, a second end for expelling the golf ball, a pliant abrasive portion adjacent the first end, a pliant liquid absorbent portion adjacent the second end, and a pliant annular member between the abrasive portion and the liquid absorbent portion and extending into the compartment.

16. Apparatus of claim 15, wherein the pliant receptacle is contained by a pliant cover.

17. Apparatus of claim 16, wherein the cover is substantially liquid impermeable.

18. Apparatus of claim 15, wherein the abrasive portion is liquid absorbent.

19. Apparatus of claim 15, wherein the abrasive portion comprises a pliant abrasive element overlying a pliant liquid absorbent backing.

* * * * *